US008518858B2

(12) United States Patent
Sekiguchi

(10) Patent No.: US 8,518,858 B2
(45) Date of Patent: Aug. 27, 2013

(54) RECEPTOR LAYER FORMING COMPOSITION AND THERMAL TRANSFER RECEIVING SHEET

(75) Inventor: Hideki Sekiguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 310 days.

(21) Appl. No.: 12/962,921

(22) Filed: Dec. 8, 2010

(65) Prior Publication Data

US 2011/0143059 A1 Jun. 16, 2011

(30) Foreign Application Priority Data

Dec. 15, 2009 (JP) ..... P2009-284359

(51) Int. Cl.
*B41M 5/50* (2006.01)

(52) U.S. Cl.
USPC ..... 503/227; 8/471; 429/32.39

(58) Field of Classification Search
None
See application file for complete search history.

(56) References Cited

U.S. PATENT DOCUMENTS 5,244,862 A 9/1993 Bailey

FOREIGN PATENT DOCUMENTS

| | | |
|---|---|---|
| EP | 1 026 001 | 8/2000 |
| EP | 2 287 008 | 2/2011 |
| JP | 57 107885 | 7/1982 |
| JP | 60 122192 | 6/1985 |
| JP | 2 592 | 1/1990 |
| JP | 2 106397 | 4/1990 |
| JP | 3 268998 | 11/1991 |
| JP | 4 115992 | 4/1992 |
| JP | 10 309874 | 11/1998 |
| JP | 10 337967 | 12/1998 |
| JP | 2008 6748 | 1/2008 |
| JP | 2008 6786 | 1/2008 |

*Primary Examiner* — Bruce H Hess
(74) *Attorney, Agent, or Firm* — Frommer Lawrence & Haug LLP; William S. Frommer; Paul A. Levy

(57) ABSTRACT

A receptor layer forming composition of a thermal transfer receiving sheet includes a core/shell-type latex which includes a core portion made from an acrylic resin (A) and a shell portion made from a urethane resin (B); and a hydrophilic acrylic resin containing hydroxyalkyl (meth)acrylate as at least one polymerizable component. The acrylic resin (A) contains substituted or unsubstituted phenoxyalkyl (meth)acrylate and/or substituted or unsubstituted phenoxy polyalkylene glycol (meth)acrylate as at least one polymerizable component thereof. The urethane resin (B) contains a carboxyl group.

7 Claims, 2 Drawing Sheets

RECEPTOR LAYER FORMING COMPOSITION AND THERMAL TRANSFER RECEIVING SHEET

BACKGROUND OF THE INVENTION

1. Field of the Invention

The present invention relates to a receptor layer forming composition used in a thermal transfer receiving sheet which is used together with a thermal transfer sheet having a thermal transfer ink layer, and a thermal transfer receiving sheet having a receptor layer formed by the composition. More specifically, the present invention relates to a receptor layer forming composition capable of forming a receptor layer in which a sense of surface roughness in an intermediate gradation portion is suppressed, and which has superior transfer density and image light-fastness, and a thermal transfer receiving sheet having a receptor layer formed by the composition.

2. Description of the Related Art

In the related art, a sublimation thermal transfer method is known as a technique of forming color or monochrome images. The sublimation thermal transfer method is a method in which a thermal transfer sheet containing thermal diffusion dyes having a property such that it is transferred by the heat of a thermal head or the like is disposed so as to face a receptor layer of a thermal transfer receiving sheet, and the thermal head is pressed against the rear side of the thermal transfer sheet, thus heating the thermal transfer sheet. The sublimation thermal transfer method forms images by heating the thermal transfer sheet so that dyes are transferred to the receptor layer as the images. Such a sublimation thermal transfer method has been noted as a method which enables image formation using digital data and gradation expressions comparable to silver halide photography without using a treatment solution such as a developing solution.

The receptor layer of the thermal transfer receiving sheet is generally formed using various thermoplastic resins as its main component. Examples of such thermoplastic resins include polyester resins, polyamide resins, acrylic resins, acetate resins, polyvinyl chloride-polyvinyl acetate resins, styrene resins, polyvinyl butyral resins, cellulose resins, and polycarbonate resins. For example, Japanese Unexamined Patent Application Publication No. 57-107885 proposes a receptor layer which is provided on a base material as a coating layer containing saturated polyester, polyvinylpyrrolidone, and pigments. Japanese Unexamined Patent Application Publication No. 60-122192 proposes a receptor layer which is formed from at least one resin selected from polyester resins, polyamide resins, acrylic resins, and acetate resins and at least one resin selected from hydrocarbon-based resins and fluorine-based resins or silicon resins.

These proposals are made to improve transfer density and image light-fastness, neither of which provides satisfactory results. Particularly, images can easily fade with light, and high-resolution printing images may not last over a long period. The reasons for this are associated to the recent progress in the printing speed of thermal transfer printers. That is, in the receptor layers as proposed hitherto, even when they are used in high-speed thermal transfer printers, since the printing time is short, it is difficult to diffuse dyes to be fixed to a receptor layer. Therefore, in the existing receptor layers, dyes are present in a state of being aggregated near the surface of a receptor layer. Thus, transfer density and image light-fastness are deteriorated.

As a base material of a thermal transfer receiving sheet, for example, Japanese Unexamined Patent Application Publication No. 2-592 proposes a synthetic paper as available under the name YUPO (trademark). Moreover, Japanese Unexamined Patent Application Publication No. 3-268998 proposes a laminate in which a foamed polyolefin layer is laminated on both surfaces of a core material.

However, a thermal transfer receiving sheet using such a base material is sensually different in finger-touch feeling, stiffness or texture, subtle difference in surface state or the like as compared to silver halide photographic paper. Thus, the thermal transfer receiving sheet is not satisfactory as a substitute for silver halide photographic paper. As a base material, for example, Japanese Unexamined Patent Application Publication No. 2-106397 or Japanese Unexamined Patent Application Publication No. 4-115992 proposes that a polyolefin laminated paper sheet in which a polyolefin layer is provided on the surface of a paper containing natural pulp as a main component may be preferably used.

However, the use of the polyolefin laminated paper sheet only is not sufficient for realizing surface smoothness, cushion, and heat insulation as necessary for the base material of the thermal transfer receiving sheet. As a base material of a thermal transfer receiving sheet, for example, Japanese Unexamined Patent Application Publication No. 2008-6748 and Japanese Unexamined Patent Application Publication No. 2008-6786 propose a base material which is coated with a layer containing hollow particles or foaming fine particles and an intermediate layer. The use of such a base material enables improvement to the coloring density and color reproduction properties while providing the same touch feeling and stiffness as the silver halide photographic paper.

However, the base material in which an intermediate layer or the like is provided so as to improve the surface smoothness, cushion, or heat insulation as proposed in the patent documents is not comparable to a base material to which a synthetic film or a synthetic paper is bonded. Therefore, it is difficult to obtain satisfactory properties such as transfer density even when the existing receptor layer is provided on the intermediate layer. Japanese Unexamined Patent Application Publication No. 10-337967 proposes a receptor layer using a core/shell structure polymer in which the core and shell each have a predetermined glass transition temperature Tg. Japanese Unexamined Patent Application Publication No. 10-309874 proposes a receptor layer having a polymer which has a core/shell structure composed of a urethane resin and a vinyl-based polymer or a micro domain structure. When a receptor layer forming composition for thermal transfer recording using a substantially water-dispersible emulsion was provided on an intermediate layer of a polyolefin laminated paper sheet used for silver halide photography, the sense of surface roughness was particularly strong in an intermediate gradation portion.

SUMMARY OF THE INVENTION

Therefore, it is desirable to provide a receptor layer forming composition which forms a receptor layer capable of obtaining superior transfer density and image light-fastness as necessary for thermal transfer recording in the current markets, and a thermal transfer receiving sheet having the receptor layer.

It is also desirable to provide a receptor layer forming composition and a thermal transfer receiving sheet capable of suppressing the sense of surface roughness in the intermediate gradation portion which can easily appear in a thermal transfer receiving sheet using a base material in which an intermediate layer is provided on a polyolefin laminated paper sheet similar to the silver halide photographic paper.

A receptor layer forming composition according to an embodiment of the present invention includes a core/shell-type latex which includes a core portion made from an acrylic resin (A) and a shell portion made from a urethane resin (B); and a hydrophilic acrylic resin containing hydroxyalkyl (meth)acrylate as at least one polymerizable component, the acrylic resin (A) contains substituted or unsubstituted phenoxyalkyl (meth)acrylate and/or substituted or unsubstituted phenoxy polyalkylene glycol (meth)acrylate as at least one polymerizable component thereof, and the urethane resin (B) contains a carboxyl group.

A thermal transfer receiving sheet according to another embodiment of the present invention includes a receptor layer which is provided on at least one surface of a base material, and the receptor layer is formed by coating and drying the receptor layer forming composition on one surface of the base material according to the embodiment.

In the embodiment of the present invention, the receptor layer formed on the base material is formed from the receptor layer forming composition including a core/shell-type latex which includes a core portion (A) and a shell portion (B); and a hydrophilic acrylic resin containing hydroxyalkyl (meth) acrylate as at least one polymerizable component. Therefore, even when images are printed at a normal or high speed, it is possible to provide superior transfer density and image light-fastness and suppress the sense of surface roughness in the intermediate gradation portion.

DESCRIPTION OF THE PREFERRED EMBODIMENTS

Figure 1:
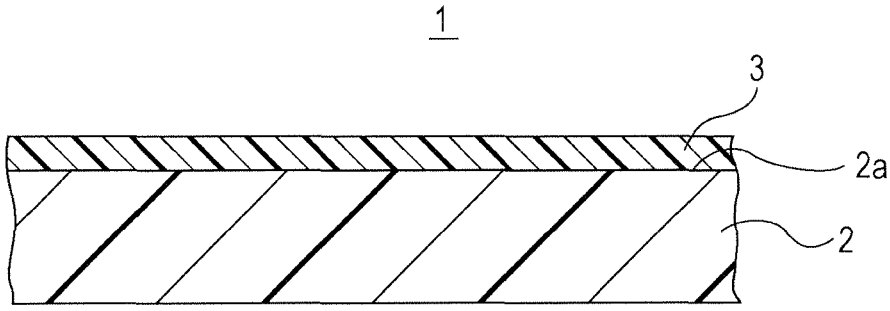
FIG. 1 is a sectional view of a thermal transfer receiving sheet according to an embodiment of the present invention.

Hereinafter, a receptor layer forming composition and a thermal transfer receiving sheet according to an embodiment of the present invention will be described with reference to the drawings. The description will be given in the following order:

1. Thermal Transfer Printing Method
2. Thermal Transfer Receiving Sheet
(1) Base Material
(2) Dye Receiving Layer and Resin Composition
3. Thermal Transfer Receiving Sheet Production Method
4. Thermal Transfer Sheet 1. Thermal Transfer Printing Method As shown in FIG. 1, a thermal transfer receiving sheet 1 includes a receptor layer 3 (hereinafter referred to as a dye receiving layer 3) which is formed on one surface 2*a* of a base material 2 so as to receive dyes. Here, prior to a description of the thermal transfer receiving sheet 1, a description will be given to a printing method by a thermal transfer printer (not shown) using the thermal transfer receiving sheet 1 and a thermal transfer sheet 4 shown in FIG. 2.

The thermal transfer printer is provided with the thermal transfer sheet 4 and capable of performing high-speed printing on the thermal transfer receiving sheet 1. The thermal transfer sheet 4 includes ink layers 6Y, 6M, and 6C of the three colors yellow, magenta, and cyan, for example, which are sequentially arranged on one surface 5*a* of a support 5 and are formed from sublimation dispersion dyes, thermal fusion dyes, or thermal diffusion dyes. A heat-resistant slipping layer 7 is provided on the other surface 5*b* of the support 5 so as to facilitate travelling properties in the thermal transfer printer.

In the thermal transfer printer, when a color image is formed on the thermal transfer receiving sheet 1 using the thermal transfer sheet 4, the thermal transfer receiving sheet 1 is first transported to a position facing the thermal transfer sheet 4. Moreover, in the thermal transfer printer, the yellow ink layer 6Y of the thermal transfer sheet 4 is superimposed on the thermal transfer receiving sheet 1 with the dye receiving layer 3 facing the ink layer 6Y so that thermal transfer sheet 4 and the thermal transfer receiving sheet 1 are disposed between a thermal head and a platen. In the thermal transfer printer, by pressing the thermal head against the platen, the ink layer 6Y is pressed onto the thermal transfer receiving sheet 1. In the thermal transfer printer, the yellow ink layer 6Y is selectively heated by the thermal head in accordance with print command information, whereby a yellow dye is thermally transferred to the thermal transfer receiving sheet 1 through sublimation, fusion or thermal diffusion. Here, for realization of high-speed printing, it is necessary for the thermal transfer receiving sheet 1 to have the dye receiving layer 3 to which the yellow dye is sufficiently diffused and fixed.

In the thermal transfer printer, after the yellow dye is thermally transferred, the thermal transfer sheet 4 is transported so that the magenta ink layer 6M is disposed between the thermal head and the platen, and the thermal transfer sheet 4 is released from the thermal transfer receiving sheet 1. In a high-speed thermal transfer printer, the thermal transfer receiving sheet 1 and the thermal transfer sheet 4 are released before the thermal transfer receiving sheet 1 and the thermal transfer sheet 4 are sufficiently cooled down. Therefore, it is necessary for the thermal transfer receiving sheet 1 to have releasing properties.

Subsequently, in the thermal transfer printer, the thermal transfer receiving sheet 1 is returned to a position facing the magenta ink layer 6M, and similarly to the yellow dye, a magenta dye is thermally transferred to the dye receiving layer 3 of the thermal transfer receiving sheet 1. Moreover, in the thermal transfer printer, similarly to the magenta dye, a cyan dye is thermally transferred to the thermal transfer receiving sheet 1, whereby a full-color image is formed.

2. Thermal Transfer Receiving Sheet

As shown in FIG. 1, the thermal transfer receiving sheet 1 includes the dye receiving layer 3 which is formed on one surface 2*a* of the base material 2 so as to receive dyes thermally transferred from the thermal transfer sheet 4. The thermal transfer receiving sheet 1 is provided with the dye receiving layer 3 which is mainly formed by coating and drying a receptor layer forming composition. The receptor layer forming composition includes a core/shell-type latex in which an acrylic resin containing substituted or unsubstituted phenoxyalkyl (meth)acrylate and/or substituted or unsubstituted phenoxy polyalkylene glycol (meth)acrylate as at least one polymerizable component thereof is used as a core portion, and a urethane resin containing a carboxyl group is used as a shell portion, and a hydrophilic acrylic resin containing hydroxyalkyl (meth)acrylate as at least one polymerizable component. Each component will be described in detail below.

(1) Base Material

As the base material 2, various paper such as art paper, coated paper, high-quality paper, cast coated paper, or polyolefin laminated paper sheet can be used. Moreover, as for the base material 2, synthetic paper such as polypropylenes or polyethylene terephthalates; synthetic resin films such as polyolefins, polyvinyl chlorides, polyethylene terephthalates, or polystyrenes, and the like can be used. Further, as the base material 2, any of the existing base materials such as porous synthetic resin films obtained by adding pigments or the like to these synthetic resin films and stretching the films so as to form micro-pores can be used. In addition, as necessary, these base materials may be combined and laminated to form the base material 2. Although the thickness of these base materials 2 is not particularly limited, the thickness is preferably about 100 to 300 μm, and more preferably 150 to 250 μm.

Figure 3:
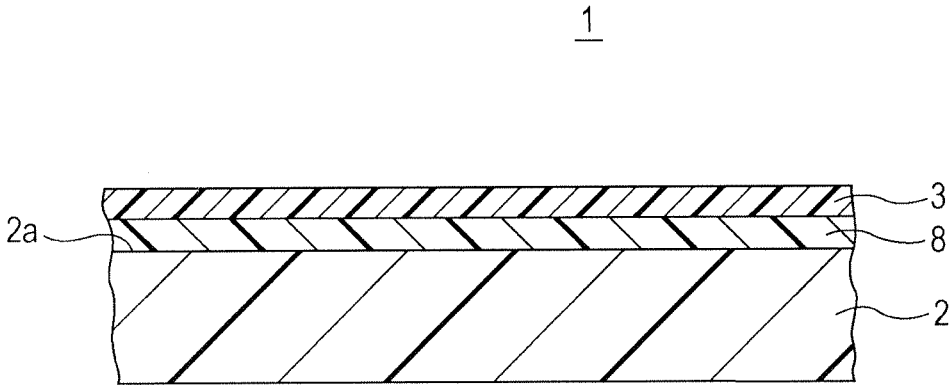
FIG. 3 is a sectional view of a thermal transfer receiving sheet according to another embodiment of the present invention.

Among these various base materials 2, a polyolefin laminated paper sheet is particularly preferred from the perspective of realizing the same finger-touch feeling, stiffness or texture, and the like as the silver halide photographic paper. Further, from the perspective of improving adhesion with the thermal head and heat insulation necessary for effective use of energy applied from the thermal head, a polyolefin laminated paper sheet in which, as shown in FIG. 3, a void layer 8 containing hollow particles is provided to be used as an intermediate layer is further preferred. A specific example of such a base material 2 is a base material proposed in Japanese Unexamined Patent Application Publication No. 2008-6748 or Japanese Unexamined Patent Application Publication No. 2008-6786, for example. Any of the existing polyolefin laminated paper sheets having the void layer can be ideally used.

The polyolefin laminated paper sheet uses various kinds of pulp, for example, of which the freeness (csf) is 100 to 400 ml and the weight-average fiber length is 0.4 to 0.8 mm. The polyolefin laminated paper sheet can be produced as follows. First, a slurry is produced by mixing the pulp and additive agents used for general papermaking such as fillers, dyes, sizing agents, dried paper strengtheners, wet paper strengtheners, fixing agents, or yield enhancing agents, as necessary. Subsequently, base paper is produced by subjecting this slurry to papermaking using a hybrid former provided with 2.5 or 3-ply plastic wire (for example, Fourdrinier paper machine having an upper dehydration mechanism as disclosed in JAPAN Journal of Pulp and Paper Industry Association, page 23, July 1988). After that, a layer of polyolefin resins which are generally and widely used such as low and high-density polyethylenes or low and high-density polypropylenes is provided on both sides of the produced base paper by various methods such as an extrusion method or a solution coating method. The present invention is not limited to this production method, and the polyolefin laminated paper sheet may be produced by other production methods. Here, the thickness of the base paper is preferably 50 to 300 μm, and more preferably, 100 to 250 μm. Moreover, the thickness of the polyolefin laminated layer is preferably 5 to 50 μm, and more preferably, 10 to 40 μm.

The void layer 8 is a layer, for example, which is coated with existing hollow particles such as fine particles of vinyl-based resins, vinylidene-based resins, and the like, or micro balloons made from glass substance, together with various binder resins such as polyvinyl alcohol resins, polyvinylpyrrolidone resins, SBR, or NBR. The void layer 8 may be a single layer or a laminate of two or more layers. The size of the hollow particles is preferably 0.1 to 20 μm, and more preferably, 0.5 to 5 μm. The additive amount of the binder resins to the hollow particles is preferably 5 to 100 mass %, and more preferably, 10 to 50 mass %. In the void layer 8, various organic or inorganic fine particles, antistatic agents, lubricants, preservative agents, wetting agents, antifoaming agents, dispersing agents, fluorescent whitening agents, cross-linking agents, and the like can be appropriately added. The density is approximately 0.3 to 0.8 cc/g, and the coating amount is about 1 to 50 g/m$^2$ in terms of dried solid content.

(2) Dye Receiving Layer

The dyes transferred from the thermal transfer sheet 4 are diffused and fixed to the dye receiving layer 3, whereby the dyes are received and held in the dye receiving layer 3. The dye receiving layer 3 is formed from a receptor layer forming composition including a core/shell-type latex which includes a core portion made from (A) and a shell portion made from (B), and a hydrophilic acrylic resin containing hydroxyalkyl (meth)acrylate as at least one polymerizable component.

Core/Shell-Type Latex

The core/shell-type latex is a dispersion in which particles having a core/shell structure of a core portion containing (A) and a shell portion containing (B) are dispersed in an aqueous medium.

The (A) contained in the core portion is an acrylic resin which contains substituted or unsubstituted phenoxyalkyl (meth)acrylate and/or substituted or unsubstituted phenoxy polyalkylene glycol (meth)acrylate as at least one polymerizable component thereof. The (B) contained in the shell portion is a urethane resin which contains a carboxyl group.

The substituted or unsubstituted phenoxyalkyl (meth)acrylate contained in the acrylic resin (A) is a monomer expressed by Formula 1 below. In Formula 1, R1 represents a hydrogen atom or a methyl group, R2 is a hydrogen atom, methyl group, or an ethyl group, and m is an integer of 1 to 3.

Formula 1

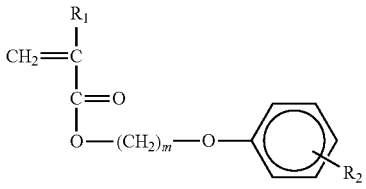

Moreover, the substituted or unsubstituted phenoxy polyalkylene glycol (meth)acrylate contained in the acrylic resin (A) is a monomer expressed by Formula 2 below. In Formula 2, R1 represents a hydrogen atom or a methyl group, R2 is a hydrogen atom, methyl group, or an ethyl group, and n is an integer of 2 or 3.

Formula 2

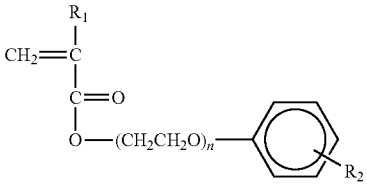

Among the phenoxyalkyl (meth)acrylate and the phenoxy polyalkylene glycol (meth)acrylate, it is particularly preferable to use unsubstituted phenoxyethyl acrylate or unsubstituted phenoxyethyl methacrylate.

The acrylic resin which forms the core portion may be a homopolymer obtained by polymerizing a single monomer of the substituted or unsubstituted phenoxyalkyl (meth)acrylate and/or the substituted or unsubstituted phenoxy polyalkylene glycol (meth)acrylate. Moreover, the acrylic resin may be a copolymer obtained by copolymerizing two or more kinds of these monomers. In addition, any of other existing (meth) acrylate monomers may be copolymerized within a range where the object of the present invention is not impaired.

Specifically, examples of such monomers include non-functional (meth)acrylic monomers such as methyl methacrylate, ethyl methacrylate, propyl methacrylate, butyl methacrylate, i-butyl methacrylate, t-butyl methacrylate, 2-ethylhexyl methacrylate, octyl methacrylate, i-decyl methacrylate, lauryl methacrylate, lauryl-dodecyl methacrylate, tridecyl methacrylate, cetyl-stearyl methacrylate, stearyl methacrylate, or cyclohexyl methacrylate, functional (meth)acrylic monomers such as dimethylamino ethyl methacrylate, glycidyl methacrylate, or tetrahydrofurfuryl methacrylate, and the like.

As for the composition ratio of various monomers when the substituted or unsubstituted phenoxyalkyl (meth)acrylate and/or the substituted or unsubstituted phenoxy polyalkylene glycol (meth)acrylate and another (meth)acrylate monomers as described above are copolymerized, the content of the phenoxyalkyl (meth)acrylate and/or phenoxy polyalkylene glycol (meth)acrylate is preferably 50 to 100 mass % with respect to the entirety of the core portion, and more particularly, 60 to 90 mass % or more.

The urethane resin (B) contained in the shell portion contains a carboxyl group as a necessary component, and such a urethane resin can be obtained by using carboxyl group-containing polyols and the like in any of the existing urethane production processes.

As the carboxyl group-containing polyols, any of the existing carboxy group-containing polyols can be used. As the carboxyl group-containing polyols, a material having one carboxyl group in its molecules is preferred, and dimethylol propionic acid (DMPA) and dimethylol butanoic acid (DMBA) are particularly preferred. The composition ratio of the carboxyl group-containing polyol in the urethane resin is preferably 2 to 15 mass %, and more preferably 5 to 10 mass %. The carboxyl group-containing polyols are used mainly for improving the water dispersing stability of the core/shell-type latex. Here, since the composition ratio of the carboxyl group-containing polyols is equal to or larger than 2 mass %, good water dispersing stability can be obtained in a desirable manner. Moreover, since the composition ratio is equal to or smaller than 15 mass %, an image blurring after long-term storage can be prevented in a desirable manner. Therefore, by setting the composition ratio of the carboxyl group-containing polyols to be in the range of 2 to 15 mass %, both favorable water dispersing stability and image blurring properties can be obtained.

Examples of an isocyanate compound used for producing such a carboxyl group-containing urethane resin include aliphatic diisocyanates such as ethylene diisocyanates, hexamethylene diisocyanates (HMDI), or tetramethylene diisocyanates; alicyclic diisocyanates such as isophorone diisocyanates (IPDI), or dicyclohexylmethane-4,4'-diisocyanates (H12MDI), and aromatic-aliphatic diisocyanates such as xylylene diisocyanates (XDI) or tetramethylxylylene diisocyanates (TMXDI). In addition to these compounds, all of existing isocyanate compounds may be used. Among these, hexamethylene diisocyanates (HMDI), isophorone diisocyanates (IPDI), dicyclohexylmethane-4,4'-diisocyanates (H12MDI), xylylene diisocyanates (XDI), and tetramethylxylylene diisocyanates (TMXDI) are non-yellowing compounds and are more preferred.

As the carboxyl group-containing urethane resin according to the present invention, the carboxyl group-containing polyols and isocyanates as above are used, and any of the existing polyol compounds can be used as another constituent component thereof. Particularly, it is preferable to use aliphatic polyester polyols or aliphatic polycarbonate polyols.

Examples of the aliphatic polyester polyols are those obtainable through a dehydration and condensation reaction between aliphatic polyalcohol components such as ethylene glycol, 1,3-propanediol, 1,4-butanediol, 1,5-pentanediol, 1,6-hexanediol, 1,7-heptanediol, 1,8-octanediol, 1,9-nanodiol, 1,10-dodecanediol, 1,11-undecanediol, 1,12-dodecanediol, 2-methyl-1,8-octanediol, neopentyl glycol, 2-ethyl-1,6-hexanediol, 2-methyl-1,3-propanediol, 3-methyl-1,5-pentanediol, 2,4-dimethyl-1,5-pentanediol, 2,4-diethyl-1,5-pentanediol, 1,3-cyclohexanediol, 1,4-cyclohexanediol, 1,4-cyclohexanedimethanol, 2-bis(4-hydroxycyclohexyl)-propane, and aliphatic polycarboxylic acid components such as oxalic acids, malonic acids, succinic acids, glutaric acids, adipic acids, pimelic acids, suberic acids, azelaic acids, sebacic acids, maleic acids, fumaric acids. All of the existing aliphatic polyester polyols can be used.

Among such aliphatic polyester polyols, it is preferable to use diols at both ends of C4-C6 straight-chain alkyl as the aliphatic polyalcohol components and carboxylic acids at both ends of C4-C6 straight-chain alkyl as the aliphatic polycarboxylic acid components. Particularly, in the aliphatic polyester polyols of the present invention, as the aliphatic polyalcohol components, it is more preferable to use 1,5-pentanediol or 1,6-hexanediol. Moreover, as the aliphatic polycarboxylic acid components, it is more preferable to use succinic acids, glutaric acids, or adipic acids, namely C4-C6 straight-chain dicarboxylic acids.

Examples of the aliphatic polycarbonate polyols are those obtainable through a polycondensation reaction between carbonate components such as alkylene carbonate (such as ethylene carbonate, trimethylene carbonate, 1,2-propylene carbonate, 1,2-butylene carbonate, 1,3-butylene carbonate, or 1,2-pentylene carbonate), dialkyl carbonate (such as dimethyl carbonate, diethyl carbonate, dipropyl carbonate, or dibutyl carbonate), or diaryl carbonate (such as diphenyl carbonate), and aliphatic polyalcohol components such as ethylene glycol, 1,3-propanediol, 1,4-butanediol, 1,5-pentanediol, 1,6-hexanediol, 1,7-heptanediol, 1,8-octanediol, 1,9-nanodiol, 1,10-dodecanediol, 1,11-undecanediol, 1,12-dodecanediol, 2-methyl-1,8-octanediol, neopentyl glycol, 2-ethyl-1,6-hexanediol, 2-methyl-1,3-propanediol, 3-methyl-1,5-pentanediol, 2,4-dimethyl-1,5-pentanediol, 2,4-diethyl-1,5-pentanediol, 1,3-cyclohexanediol, 1,4-cyclohexanediol, 1,4-cyclohexanedimethanol, or 2-bis(4-hydroxycyclohexyl)-propane. All of the existing aliphatic polycarbonate polyols can be used.

Among such aliphatic polycarbonate polyols, it is preferable to use aliphatic polycarbonate polyol including a C4-C6 straight-chain alkylene diol as its main component, such as polycarbonate polyol of 1,6-hexanediol, polycarbonate polyol of 1,6-hexanediol and 1,4-butanediol, polycarbonate polyol of 1,6-hexanediol and 1,5-pentanediol, or polycarbonate polyol of 1,6-hexanediol and 3-methyl-1,5-pentanediol.

By using the aliphatic polyester polyols or aliphatic polycarbonate polyols as above, it is possible to obtain more superior transfer density and image light-fastness.

Moreover, in the urethane resin of the present invention, existing chain extenders such as ethylene glycol, diethylene glycol, propylene glycol, dipropylene glycol, 1,4-butanediol, 1,3-butanediol, 1,5-pentanediol, 3-methyl-1,5-pentanediol, neopentyl glycol, 1,6-hexanediol, or trimethylolpropane can be appropriately used.

The average molecular weight of the acrylic resin of the present invention is preferably 50,000 to 200,000, and more preferably, 70,000 to 150,000. On the other hand, the average molecular weight of the urethane resin is preferably 5,000 to 100,000, and more preferably 20,000 to 70,000. Since the average molecular weights of the acrylic resin and the urethane resin are equal to or larger than 50,000 and 5,000, respectively, the film strength of the dye receiving layer 3 will not deteriorate, and scratches will difficult to form. In addition, it is desirable because it is possible to prevent the occurrence of a blockage on the rear surface of the thermal transfer receiving sheet 1 and the dye receiving layer 3 which overlap with each other when the thermal transfer receiving sheets 1 are stored in a superimposed manner.

The core/shell ratio (mass ratio) between the core portion containing the acrylic resin (A) and the shell portion containing the urethane resin (B) is preferably 8/2 to 4/6, and more preferably 7/3 to 5/5. Here, if the core/shell ratio exceeds 8/2 and becomes 9/1, for example, the proportion of the acrylic resin (core portion) becomes too high, and it is undesirable that the transfer density and the image light-fastness should deteriorate. On the other hand, if the core/shell ratio exceeds 4/6 and becomes 3/7, for example, the proportion of the acrylic resin (core portion) becomes too low, and it is undesirable that the releasing properties during printing and the image blurring properties after long-term storage should deteriorate.

As a method of preparing the core/shell-type latex, a method of adding components such as monomers and oligomers that constitute the acrylic resin in the presence of a latex containing resin particles made from a urethane resin and subjecting the mixture to emulsion polymerization may be used. Any of the existing synthetic methods can be appropriately used as the preparation method of the core/shell-type latex.

In the emulsion polymerization, for example, a method of subjecting a mixed solution of the monomers and oligomers that constitute the urethane resin and acrylic resin to emulsion polymerization may be used. Moreover, in the emulsion polymerization, a method of subjecting a mixed solution of the urethane resin and the monomers and oligomers that constitute the acrylic resin to emulsion polymerization in the presence of resin particles that constitute the urethane resin may be used. Here, the monomers and oligomers that constitute the acrylic resin or a mixed solution of the monomers and oligomers and the urethane resin may be emulsified in advance and used. In addition, a method where such a mixed solution and the monomers and oligomers that constitute the acrylic resin are added in one step to obtain a mixture and the mixture is subjected to polymerization may be used. Alternatively, a method where, after such a mixed solution and the monomers and oligomers that constitute the acrylic resin are added in part to obtain a mixture and the mixture is subjected to polymerization, a residual part is added to the resulting polymerized material to obtain a mixture and the mixture is subjected to polymerization may be used.

Although all of the existing emulsifying agents can be used for the emulsion polymerization, since an image blurring after long-term storage may be caused depending on the kind of emulsifying agents or the additive amount thereof, the range of usable emulsifying agents should be limited to a range where there is no such problem. Examples of such emulsifying agents include non-ionic surfactants such as polyoxyethylene lauryl ether, polyoxyethylene oleyl phenyl ether, polyoxyethylene nonyl phenyl ether, or oxyethylene-oxypropylene block copolymer; anionic surfactants such as sodium dodecyl benzene sulfonate, sodium alkyl diphenyl ether disulfonate, sodium alkyl naphthalene sulfonate, sodium lauryl sulfate, sodium polyoxyethylene alkyl ether sulfate, sodium polyoxyethylene alkylphenyl ether sulfate, or dialkyl sodium sulfosuccinate; or protective colloids such as polyvinyl alcohol or various water-soluble polymers.

Moreover, various existing polymerization initiators may be used in the emulsion polymerization. Examples of such polymerization initiators include persulfate such as potassium persulfate, sodium persulfate, or ammonium persulfate, and hydrogen peroxide. For the purpose of adjusting the molecular weight of the resins, various existing chain transfer agents may be used. Examples of such chain transfer agents include alcohols such as catechols; thiols; and mercaptans. The polymerization temperature can be appropriately adjusted in the range of about 30 to 100° C. depending on the kind of polymerization initiators. Further, the pH value of the latex can be preferably adjusted within a range of pH5 to 10, and more preferably, within a range of pH6 to 9, which corresponds to a region ranging from neutral to mild alkaline.

The average particle diameter of the core/shell-type latex of the acrylic resin and urethane resin according to the present invention is preferably 0.001 to 5 μm, and more preferably about 0.01 to 2 μm. The average particle diameter may be appropriately adjusted within a range where water dispersing stability, film formation properties, adhesion, and the like are not impaired.

The solvent of the core/shell-type latex is mainly composed of water. Moreover, various other organic solvents may be added to the solvent within a range where the object of the present invention is not impaired. Examples of such organic solvents include alcohols such as methanol, ethanol, n-propanol, or i-propanol; glycols such as ethylene glycol or propylene glycol; glycol derivatives such as methyl cellosolve or ethyl cellosolve; ethers such as tetrahydrofuran or dioxane; ketones such as methyl ethyl ketone or cyclohexane, and esters such as ethyl acetate. Therefore, the solvent of the receptor layer forming composition according to the present invention is mainly composed of water, and various other organic solvents as described above are added thereto within a range where the object of the present invention is not impaired.

The receptor layer forming composition according to the present invention contains, as its necessary components, the hydrophilic acrylic resin containing the hydroxyalkyl (meth) acrylate at least one polymerizable component together with the latex as described above.

As for the hydroxyalkyl (meth)acrylate, any of the existing hydroxyalkyl (meth)acrylates can be appropriately used. Examples of such hydroxyalkyl (meth)acrylates include hydroxymethyl (meth)acrylate, 2-hydroxyethyl (meth)acrylate, 3-hydroxypropyl (meth)acrylate, 2-hydroxypropyl (meth)acrylate, 4-hydroxybutyl (methacrylate), and 2-hydroxybutyl (meth)acrylate, 6-hydroxyhexyl (meth)acrylate. Among these hydroxyalkyl (meth)acrylates, it is particularly preferable to use hydroxyalkyl (meth)acrylate having a C1-C3 alkyl chain as it can improve the coating properties and light-fastness of the receptor layer forming composition. Specifically, hydroxymethyl (meth)acrylate, 2-hydroxyethyl (meth)acrylate, 3-hydroxypropyl (meth)acrylate, or 2-hydroxypropyl (meth)acrylate are most preferably used.

Although the hydrophilic acrylic resin contains at least one of the hydroxyalkyl (meth)acrylates, existing monomers may be used as other polymerizable components within a range where the object of the present invention is not impaired. Specifically, examples of such monomers include non-functional (meth)acrylic monomers such as acrylate, methyl methacrylate, ethyl methacrylate, propyl methacrylate, butyl methacrylate, i-butyl methacrylate, t-butyl methacrylate, 2-ethylhexyl methacrylate, octyl methacrylate, i-decyl methacrylate, lauryl methacrylate, lauryl-dodecyl methacrylate, tridecyl methacrylate, cetyl-stearyl methacrylate, stearyl methacrylate, or cyclohexyl methacrylate, functional (meth) acrylic monomers such as dimethylamino ethyl methacrylate, glycidyl methacrylate, or tetrahydrofurfuryl methacrylate, and the like.

The copolymerization ratio of the hydroxyalkyl (meth) acrylate and the other polymerizable components is preferably 50:50 to 90:10 in terms of mass ratio. The average molecular weight of the hydrophilic acrylic resin is preferably 5,000 to 200,000, and more preferably 10,000 to 150,000. Moreover, the additive amount of the hydrophilic acrylic resin with respect to the solid content of the latex is preferably approximately 5 to 50 mass %, and more preferably 10 to 40 mass %.

When the receptor layer forming composition is coated, dried, and formed into a film on the base material 2 described later to obtain the dye receiving layer 3, a hydrophilic acrylic resin is used particularly for the purpose of reducing the sense of surface roughness and increasing the coloring density. In the thermal transfer receiving sheet 1, since the hydrophilic acrylic resin is added to the receptor layer forming composition, the receptor layer forming composition can rarely penetrate into the base material 2 and the void layer 8. Thus, the receptor layer forming composition can be evenly coated on the base material 2 and the void layer 8, and the coating properties are improved. Moreover, since the hydrophilic acrylic resin is contained in the receptor layer forming composition, it is possible to improve the light-fastness of the dye receiving layer 3. For example, as shown in FIG. 3, the receptor layer forming composition is suppressed from penetrating into the void layer 8 which contains the hollow particles. Therefore, in the thermal transfer receiving sheet 1, it is possible to provide an excellent dye receiving layer 3 which is homogeneous and has a high coloring density and in which there is no sense of surface roughness after printing. Therefore, the resin contained in the receptor layer forming composition may not be said to be good unless it is a hydrophilic resin. Further, even if it is a hydrophilic acrylic resin, unless it contains the specific acrylic monomers, the object of the present invention may not be achieved.

By adjusting the copolymerization ratio of the hydroxyalkyl (meth)acrylate in the hydrophilic acrylic resin to be equal to or larger than 50 mass %, the coating properties can be sufficiently improved, and the sense of surface roughness can be improved to a desirable level. Moreover, by adjusting the average molecular weight of the hydrophilic acrylic resin to be equal to or larger than 5,000, the coating properties can be sufficiently improved, and the sense of surface roughness can be improved to a desirable level. On the other hand, by adjusting the average molecular weight of the hydrophilic acrylic resin to be equal to or smaller than 200,000, a sufficient coloring density can be obtained. Moreover, the additive amount of the hydrophilic acrylic resin to the receptor layer forming composition is equal to or larger than 5 mass % and equal to or smaller than 50 mass %. By adjusting the additive amount of the hydrophilic acrylic resin to be equal to or larger than 5 mass %, the coating properties can be sufficiently improved, and the sense of surface roughness can be improved to a desirable level. By adjusting the additive amount to be equal to or smaller than 50 mass %, a sufficient coloring density can be obtained.

As for a method for producing the hydrophilic acrylic resin of the present invention, any of the existing acrylic resin synthesis methods such as suspension polymerization, continuous solution polymerization, emulsion polymerization can be appropriately used. Specifically, the hydrophilic acrylic resin can be produced, for example, by solution polymerization in which water; alcohols such as methyl alcohols, ethyl alcohols, or isopropyl alcohols; aromatic or aliphatic hydrocarbons such as benzene, toluene, xylene, cyclohexane, or n-hexane; ester compounds such as ethyl acetate; ketone compounds such as acetone or methyl ethyl ketones; and cyclic ether compound such as tetrahydrofuran or dioxane are appropriately used as a solvent. Here, when aqueous solution polymerization is carried out, as for a radical polymerization initiator, persulfate such as ammonium persulfate, sodium persulfate, or potassium persulfate; hydrogen peroxide; azoamidine compounds such as 2,2'-azobis-2-methylpropionamidine hydrochloride, and cyclic azoamidine compounds such as 2,2'-azobis-2-(2-imidazoline-2-yl)propane hydrochloride can be used.

In the polymerization methods, a method of charging the respective monomers into a reaction chamber is not particularly limited. Examples of the method include a method of charging the total amount of the monomers into the reaction chamber in one step in early stages; a method of charging the total amount of the monomers into the reaction chamber in portions or continuously; a method of charging part of the monomers into the reaction chamber in early stages, and then charging the rest of the monomers into the reaction chamber in portions or continuously. The radical polymerization initiator may be initially charged or added dropwise into the reaction chamber. These methods may be combined depending on the purpose.

Moreover, an existing hydrophilic chain transfer agent may be used in order to adjust the molecular weight of the hydrophilic acrylic resin. Examples of such a chain transfer agent include thiol chain transfer agents such as mercaptoethanol, thioglycerol, thioglycolic acid, 3-mercaptopropionic acid, thiomalic acid, or 2-mercaptoethanesulfonic acid; secondary alcohols such as isopropyl alcohol; and lower oxides and salts thereof, such as phosphorous acid, hypophosphorous acid and salts thereof (sodium hypophosphite, potassium hypophosphite, and the like), sulfurous acid, hydrogen sulfite, dithionous acid, and metabisulfurous acid and salts thereof (sodium sulfite, sodium hydrogen sulfite, sodium dithionite, sodium metabisulfite, and the like).

Various other additive agents may be added to the receptor layer forming composition and the dye receiving layer 3 within a range where the object of the present invention is not impaired. Examples of such additive agents include other kinds of latexes and other kinds of water-soluble resins. Additional examples thereof include release agents such as cross-linking agents, silicon oil, modified silicon oil, fluorine compounds, or long-chain alkyl group-modified compounds; lubricants such as polyethylene wax or stearic wax; and plasticizers, pigments, wetting agents, defoamers, dispersants, antistatic agents, fluorescent whitening agents, UV absorbers, light stabilizers, and cross-linking agents.

In the thermal transfer receiving sheet 1, any of the existing backcoat layers may be provided on a surface of the base material 2 opposite the dye receiving layer 3 for the purpose of improving transporting properties in the printer and imparting writing properties or enhancing opacity. The backcoat layer is made from various organic or inorganic fine particles, antistatic agents, lubricants, preservative agents, wetting agents, antifoaming agents, dispersing agents, fluorescent whitening agents, cross-linking agents, binder resins, and the like, and the coating amount thereof is about 0.1 to 5 $g/m^2$ in terms of dried solid content. Moreover, any of the existing barrier layers may be provided between the void layer 8 and the dye receiving layer 3 for the purpose of improving image preservation properties after printing. The barrier layer is formed by adding appropriately organic or inorganic fine particles to resins such as polyvinyl alcohol, ethylene vinyl alcohol copolymers, or SBR and coating the mixture to an amount of about 0.1 to 5 g/m$^2$ in terms of a dried solid content.

3. Thermal Transfer Receiving Sheet Production Method

The thermal transfer receiving sheet 1 having the above-described structure can be produced by a method in which the above-described resin composition is applied to at least one surface 2*a* of the base material 2 by the following method and dried at predetermined temperature for a predetermined period, whereby the dye receiving layer 3 is formed, and the thermal transfer receiving sheet 1 is obtained.

As for a method of coating the dye receiving layer 3 on the base material 2, methods which use a curtain coater, a dye coater, an air-knife coater, a blade coater, a gate roll coater, a bar coater, a rod coater, a roll coater, gravure coater, and the like can be used. Any of the existing coating methods can be used. When the void layer 8 and the barrier layer are provided, materials of the void layer 8, materials of the barrier layer, and the receptor layer forming composition of the dye receiving layer 3 may be laminated in a fluid form using a die coater or the like and coated at once on the base material 2. Such a method is economically efficient and is one of the best production methods of the thermal transfer receiving sheet 1. Moreover, as necessary, an easy adhesion treatment such as a corona discharge or plasma treatment may be applied to the polyolefin laminated layer and/or the void layer 8 so as to improve adhesion between respective layers.

The coating amount of the receptor layer forming composition that forms the dye receiving layer 3 is preferably 0.5 to 30 g/m$^2$ with respect to the dried solid content, and more preferably, 1 to 5 g/m$^2$. Although it is not necessarily appropriate, when the coating amount is equal to or larger than 0.5 g/m$^2$, the dye receiving layer 3 can sufficiently receive dyes, and accordingly, the transfer density increases, and the image light-fastness is improved. On the other hand, when the coating amount is equal to or smaller than 30 g/m$^2$, it is economically efficient without any deterioration in the transfer density.

In some production method of the thermal transfer receiving sheet 1, there is a case where an aqueous coating layer is formed on the surface of the base material 2 made from various papers, synthetic papers, synthetic resin films, and the like, and the resin composition that forms the dye receiving layer 3 is applied on the coating layer without any cushion layer thereon. In this case, in the production method of the thermal transfer receiving sheet 1, the use of the resin composition of the present invention which uses water as a medium is more economical and better able to simplify the production processes than the use of the resin composition of the related art where an organic solvent such as toluene is used as a medium.

As described above, the thermal transfer receiving sheet 1 includes the dye receiving layer 3 which is provided on the base material 2, and which is formed from the resin composition including the core/shell-type latex which includes a core portion that contains the acrylic resin (A) and a shell portion that contains the urethane resin (B), and the hydrophilic acrylic resin containing hydroxyalkyl (meth)acrylate as at least one polymerizable component. Due to such a structure, since the specific core/shell-type latex and the specific hydrophilic acrylic resin cross-linking agent are contained in the dye receiving layer 3, the thermal transfer receiving sheet 1 can provide excellent releasing properties from the thermal transfer sheet 4 and prevent the sense of surface roughness even when high-speed printing is performed. Moreover, the thermal transfer receiving sheet 1 has high coloring density and light-fastness and can suppress an image blurring even after long-term storage in a hot and humid environment.

4. Thermal Transfer Sheet

Figure 2:
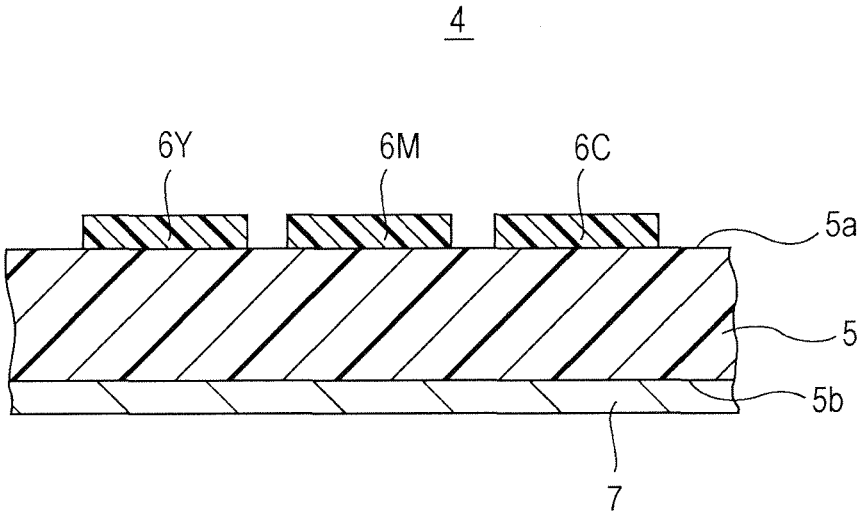
FIG. 2 is a sectional view of a thermal transfer sheet.

As the thermal transfer sheet 4 that transfers dyes to the thermal transfer receiving sheet 1 described above, any of the existing thermal transfer sheets can be appropriately used. Specifically, as shown in FIG. 2, the thermal transfer sheet 4 includes yellow, magenta, and cyan ink layers 6Y, 6M, and 6C (also referred to simply as an ink layer 6) which are arranged on the support 5. The thermal transfer sheet 4 thermally transfers the dyes contained in the ink layer 6 to the dye receiving layer 3 of the thermal transfer receiving sheet 1 during printing.

As the thermal transfer sheet 4, any of the existing thermal transfer sheets can be appropriately used. Specifically, dyes which are to be diffused and transferred to the dye receiving layer 3 of the thermal transfer receiving sheet 1 during printing are contained in the ink layer 6 of the thermal transfer sheet 4. For example, as for the yellow dye, azo dyes, disazo dyes, methine dyes, styryl dyes, pyridone-azo dyes, and the like and mixtures thereof can be used. As for the magenta dye, azo dyes, anthraquinone dyes, styryl dyes, heterocyclic azo dyes, and the like and mixtures thereof can be used. As for the cyan dyes, anthraquinone dyes, naphthoquinone dyes, heterocyclic azo dyes, indoaniline dyes, and the like and mixtures thereof can be used.

As for the binder resin that holds the respective dyes and forms the ink layer 6, cellulose resins such as methyl cellulose, ethyl cellulose, hydroxyethyl cellulose, hydroxypropyl cellulose, or acetate cellulose, vinyl resins such as polyvinyl alcohol, polyvinyl butyral, polyvinyl acetoacetal, polyvinyl acetate, or polystyrene, urethane resins, and the like can be used.

As for the support 5, plastic films such as polyester films, polystyrene films, polypropylene films, polysulfone films, polycarbonate films, polyimide films, or aramid films, papers, synthetic papers, and the like can be used. The thickness of the support 5 is usually about 1 to 30 μm.

The thermal transfer sheet 4 may have a structure in which the yellow, magenta, and cyan ink layers 6Y, 6M, and 6C, and as necessary, a black ink layer are sequentially and adjacently provided on one surface of the support 5 described above. As for the thermal transfer sheet 4, a sensor mark may be provided so that the printer can detect the position of the thermal transfer sheet 4. As for the thermal transfer sheet 4, a transparent transfer protection layer may be provided so as to protect an image which is formed when the respective dyes are transferred to the dye receiving layer 3.

When the thermal transfer printer performs printing using the thermal transfer receiving sheet 1 and the thermal transfer sheet 4, the yellow ink layer 6 is heated in a state where the yellow ink layer 6Y faces the dye receiving layer 3, and the yellow dye is thermally transferred to the dye receiving layer 3. In the thermal transfer receiving sheet 1, since the dye receiving layer 3 is formed from the resin composition which includes the core/shell-type latex and the hydrophilic acrylic resin including the hydroxyalkyl (meth)acrylate as at least one polymerizable component thereof, the yellow dye can be sufficiently diffused and fixed to the dye receiving layer 3. Moreover, in order to transfer the magenta dye to the thermal transfer receiving sheet 1, the thermal transfer sheet 4 is transported so that the magenta ink layer 6M faces the thermal head and the platen, and the thermal transfer sheet 4 is released from the thermal transfer receiving sheet 1. Since the dye receiving layer 3 is formed from the above-described resin composition, the thermal transfer receiving sheet 1 has high releasing properties, and the thermal transfer sheet 4 can be released without any problem. After the magenta dye is transferred, similarly, the cyan dye is transferred to the thermal transfer receiving sheet 1, and images can be formed. In this case, the magenta and cyan dyes can be sufficiently diffused and fixed to the dye receiving layer 3, and the thermal transfer receiving sheet 1 is easily released from the thermal transfer sheet 4.

Given the above, in the thermal transfer receiving sheet 1, since the dye receiving layer 3 is formed from the resin composition which contains a specific latex and a hydrophilic acrylic resin having a specific polymerizable component, it is possible to suppress a sense of surface roughness in the intermediate gradation portion even during high-speed printing. Moreover, the thermal transfer receiving sheet 1 provides superior transfer density and light-fastness.

Moreover, in the thermal transfer receiving sheet 1, since the dye receiving layer 3 is formed from a resin composition, it is possible to suppress an image blurring even when the thermal transfer receiving sheet 1 is stored over a long period in a hot and humid environment. Further, the thermal transfer receiving sheet 1 has superior releasing properties and can be released from the thermal transfer sheet 4 without any problem.

Therefore, even when the thermal transfer receiving sheet 1 is subjected to the high speed printing as well as the normal speed printing, it is possible to form high-quality images in which there is no sense of surface roughness in the intermediate gradation portion, and the transfer density and light-fastness are superior.

EXAMPLES

Specific examples to which the present invention is applied will be described in detail based on test results. However, the details of the present invention are not limited to these examples, and "parts" and "%" in the examples represent mass parts and mass %.

Production of Latex Used for Receptor Layer Forming Composition A

A method for producing the latex used for the receptor layer forming composition A will be described. First, 35 parts of ELITEL 3320 (product of UNITIKA Ltd.; UE3320 in Table 1), 25 parts of PLACCEL 220A (product of DAICEL Chemical Corp.; 220AL in Table 1), 10 parts of DMPA (2,2-dimethylol propionic acid), and 20 parts of methylethyl ketone were charged into a reactor having a circulating cooler and stirred at 90° C. until the mixture became homogeneous. Subsequently, after circulation of the solvent was ensured, 30 parts of IPDI (isophorone diisocyanate) was added and polymerized to obtain a urethane prepolymer. In addition, 2.75 parts of ethylene diamine and 170 parts of ion-exchange water were stirred at a condition of 25° C. using a homogenizer, and the urethane prepolymer was charged into the mixture, and the stirring was continued until chain extension was completed. The mixture was subjected to desolvation and dehydrogenation while continuing the stirring under a low-pressure condition at 40° C. to obtain a urethane dispersion (35% solid form). Then, 290 g of the urethane dispersion and 60 g of ion-exchange water was charged into a reactor having a circulating cooler and stirred and heated to a temperature of 75° C. To this mixture obtained thus, 100 parts of PEMA (phenoxy ethyl methacrylate) and 100 g of ion-exchange water and potassium persulfate catalyst solution were dropped for 2 hours, and stirred for 1 hour, whereby a latex used for the receptor layer forming composition A was produced.

Production of Hydrophilic Acrylic Resin Used for Receptor Layer Forming Composition A Next, a method for producing the hydrophilic acrylic resin used for the receptor layer forming composition A will be described. 1600 parts of ion-exchange water was charged into a reactor having a circulating cooler, and the mixture was stirred and heated to a temperature of 68° C. while supplying nitrogen gas at a flow rate of 200 mL/minute. Subsequently, a mixture of 320 parts of HMMA (hydroxymethyl methacrylate), 80 parts of AA (acrylate), and 2 parts of 2,2'-azobis(2-amidinopropane)dihydrochloride was added in portions for 5 times every 30 minutes. After 1 hour after the total amount was added, a solution of 0.6 parts of 2,2'-azobis(2-amidinopropane)dihydrochloride was added. In addition, after the mixture was stirred for 2 hours, the mixture was cooled to room temperature, whereby the hydrophilic acrylic resin used for the receptor layer forming composition A was prepared.

Production of Latex and Hydrophilic Acrylic Resin Used for Receptor Layer Forming Compositions B to S By the same production method as the latex and the hydrophilic acrylic resin used for the receptor layer forming composition A, the respective latexes and hydrophilic acrylic resins used for the receptor layer forming compositions B to S having the compositions shown in Table 1 were prepared. The properties of the respective latexes and hydrophilic acrylic resins are described in Table 1. The names of the resin compositions in Table 1 are described in Table 2.

TABLE 1

| | | | Example | | | | | | | | | | | |
|---|---|---|---|---|---|---|---|---|---|---|---|---|---|---|
| | | | 1 | 2 | 3 | 4 | 5 | 6 | 7 | 8 | 9 | 10 | 11 | 12 |
| Latex | Core | Resin Compositions | A | B | C | D | E | F | G | H | I | J | K | L |
| | | PEMA | 100 | | 62 | 62 | 100 | 100 | 100 | 100 | 100 | 100 | 100 | 80 |
| | | PEO2MA | | 100 | | | | | | | | | | |
| | | 2HEMA | | | | | | | | | | | | 20 |
| | | EHA | | | 38 | 38 | | | | | | | | |
| | | St | | | | | | | | | | | | |
| | | BZ | | | | | | | | | | | | |
| | Shell | PTMG2000 | | | 60 | 60 | | | | | | | | |
| | | NS2400 | | | | | | | | 53 | 55 | | | |
| | | P1010 | | | | | | | | | | | | |
| | | T5652 | | | | | | | | | | 67 | 55 | 55 |
| | | UE3320 | 35 | 35 | | | 35 | 35 | 35 | | | | | |
| | | 220AL | 25 | 25 | | | 25 | 25 | 25 | | | | | |
| | | NPG | | | | | | | | 5 | 5 | | 5 | 5 |
| | | DMPA | 10 | 10 | 10 | 10 | 10 | 10 | 10 | 5 | 5 | 5 | 5 | 5 |

TABLE 1-continued

| | | | | | | | | | | | | | |
|---|---|---|---|---|---|---|---|---|---|---|---|---|---|
| | | IPDI | 30 | 30 | 30 | 30 | 30 | 30 | 30 | | 35 | | 35 | 35 |
| | | H12MDI | | | | | | | | 37 | | 28 | | |
| | | Core/shell Ratio | 5/5 | 5/5 | 5/5 | 5/5 | 5/5 | 5/5 | 5/5 | 4/6 | 4/6 | 4/6 | 4/6 | 5/5 |
| | Mw | Core | 15 | 15 | 15 | 15 | 15 | 15 | 15 | 10 | 10 | 10 | 10 | 10 |
| | (×104) | Shell | 14 | 1.4 | 14 | 1.4 | 14 | 1.4 | 1.4 | 2 | 2 | 2 | 2 | 2 |
| | | Solid Content (%) | 36.6 | 38.9 | 36.8 | 36.8 | 36.6 | 36.6 | 36.6 | 41.8 | 38.9 | 39.3 | 39.2 | 48.8 |
| Hydrophilic | | HMMA | 80 | | | | | | | | 80 | | | |
| acrylic resin | | 2HEMA | | 80 | 80 | | | 50 | 75 | | | 80 | | 100 |
| or | | 3HPMA | | | | | | 50 | | | | | | |
| other | | 2HPMA | | | | | | | 25 | | | | | |
| Hydrophilic | | AA | 20 | 20 | 20 | 100 | 100 | | | 20 | 100 | 20 | 100 | |
| Resin | | K90 | | | | | | | | | | | | |
| | | PVA117 | | | | | | | | | | | | |
| | | Mw ($\times 10^4$) | 5 | 5 | 5 | — | — | 5 | 5 | 5 | — | 5 | — | 5 |
| | | Additive Amount wt % (Latext Solid Content) | 20 | 20 | 10 | 10 | 20 | 20 | 20 | 20 | 20 | 20 | 20 | 5 |

| | | | | Comparative Example | | | | | | |
|---|---|---|---|---|---|---|---|---|---|---|
| | | | | 1 | 2 | 3 | 4 | 5 | 6 | 7 |
| Latex | Core | Resin Compositions | | M | N | O | P | Q | R | S |
| | | PEMA | | 100 | 62 | 62 | 62 | | | |
| | | PEO2MA | | | | | | | | |
| | | 2HEMA | | | | | | | | |
| | | EHA | | | 38 | 38 | 38 | 30 | 25 | 15 |
| | | St | | | | | | 70 | 75 | |
| | | BZ | | | | | | | | 85 |
| | Shell | PTMG2000 | | 60 | 60 | 60 | | | | |
| | | NS2400 | | | | | | | | |
| | | P1010 | | | | | | 47 | 47 | 47 |
| | | T5652 | | | | | | | | |
| | | UE3320 | | 35 | | | | | | |
| | | 220AL | | 25 | | | | | | |
| | | NPG | | | | | | 2 | 2 | 2 |
| | | DMPA | | 10 | 10 | 10 | 10 | 10 | 10 | 10 |
| | | IPDI | | 30 | 30 | 30 | 30 | 41 | 41 | 41 |
| | | H12MDI | | | | | | | | |
| | | Core/shell Ratio | | 5/5 | 5/5 | 5/5 | 5/5 | 5/5 | 5/5 | 5/5 |
| | Mw | Core | | 15 | 15 | 15 | 15 | 15 | 15 | 15 |
| | (×104) | Shell | | 14 | 1.4 | 14 | 14 | 1.4 | 14 | 1.4 |
| | | Solid Content (%) | | 36.6 | 36.8 | 36.8 | 36.8 | 35.8 | 36.8 | 35.7 |
| Hydrophilic | | HMMA | | | | | | | | |
| acrylic resin | | 2HEMA | | | | | | 80 | 100 | 80 |
| or | | 3HPMA | | | | | | | | |
| other | | 2HPMA | | | | | | | | |
| Hydrophilic | | AA | | | | | | 20 | | 20 |
| Resin | | K90 | | | | 100 | | | | |
| | | PVA117 | | | | | 100 | | | |
| | | Mw ($\times 10^4$) | | | | 36 | 7.5 | 5 | 5 | 5 |
| | | Additive Amount wt % (Latext Solid Content) | | 0 | 0 | 10 | 20 | 20 | 20 | 20 |

TABLE 2

| | |
|---|---|
| PEMA | phenoxyethyl methacrylate |
| PEO2MA | phenyl ethylene oxide (2 moles), modified methacrylate |
| HMMA | hydroxymethyl methacrylate |
| 2HEMA | 2-hydroxymethyl methacrylate |
| EHA | ethylhexyl acrylate |
| 3HPMA | 3-hydroxypropyl methacrylate |
| 2HPMA | 2-hydroxypropyl methacrylate |
| AA | acrylic acid |
| St | styrene |
| BZ | benzyl methacrylate |
| MMA | methyl methacrylate |
| NPG | neopentyl glycol |
| DMPA | dimethylol propionic acid |
| IPDI | isophorone diisocyanate |
| H12MDI | 4,4'-methylene bis(cyclohexyl isocyanate) |
| PTMG2000 | polytetramethylene glycol (Mw 2000: product of Mitsubishi Chemical) |
| NS2400 | 1,5-penthane diol + adipic acid polyester (Mw 2000), product of Asahi Denka Corp. |

TABLE 2-continued

| | |
|---|---|
| P1010 | 1,5-penthane diol + adipic acid polyester (Mw 1000), Kuraray-Polyol (product of Kuraray Corp.) |
| T5652 | 1,6-hexanediol-based polycarbonate (Mw 1000), DURANOL (product of Asahi Kasei Corp.) |
| UE3320 | phthalate polyester diol (Mw 2000), ELITEL (product of UNITIKA Ltd.) |
| 220AL | caprolactone diol (Mw 1800), PLACCEL (product of DAICEL Ltd.) |
| K90 | polyvinylpyrrolidone (product of BASF Corp.) |
| PVA117 | polyvinyl alcohol (product of Kuraray Corp.) |

Preparation of Receptor Layer Forming Compositions A to S

Hydrophilic acrylic resins shown in Table 1 or other hydrophilic resins were added to the respective latexes A to S, and 0.5 parts (with respect to solid latex) of modified silicon oil (product name: X22-4272, Shin-Etsu Silicon Corp.) was added. Then, finally, pure water was added to be 10% of the solid content, whereby resin compositions A to S were prepared.

Production of Thermal Transfer Receiving Sheet

The respective prepared receptor layer forming compositions A to S shown in Table 1 were coated on the void layer of the base material using a Meyer bar #8 so that the dried coating amount was 2.5 g/m$^2$. Then, the coating was dried at 100° C. for one minute to form the receptor layer, whereby the respective thermal transfer recording sheets of Examples 1 to 11 and Comparative Examples 1 to 5 were obtained. As the base material, a polyolefin laminated paper sheet was used in which a low-density polyethylene layer is provided on both sides of a base paper having a basis weight of 150 g/m$^2$ and a density of 1.01 g/cm$^3$ using a melt extrusion laminator so that the basis weight on both sides thereof becomes 25 g/m$^2$, and the front surface is subjected to a hydrophilic treatment through corona processing. Further, a void layer having the following composition (solid content) is coated on the hydrophilic treatment surface so that the dried coating amount becomes 15 g/m$^2$, and the coating is dried at 100° C. for one minute.

Void Layer

Ropaque Ultra-E (hollow particle; product of Rohm & Haas) 100 parts

PVA-117 (binder resin: product of Kuraray) 20 parts

Glyoxal (cross-linking agent) 3 parts

Evaluation

The following evaluations were conducted on the respective thermal transfer recording sheets of Examples and Comparative Examples produced as above, and the results are described in Table 3.

TABLE 3

| Examples and Comparative Examples | | Resin Compositions | Sense of Roughness | Coloring Density | Light Resistance (ΔE*) |
|---|---|---|---|---|---|
| Example | 1 | A | ◎ | 2.04 | 3.2 |
| | 2 | B | ◎ | 2.01 | 3.3 |
| | 3 | C | ◎ | 2.05 | 3.5 |
| | 4 | D | ○ | 1.94 | 3.5 |
| | 5 | E | ○ | 1.95 | 3.3 |
| | 6 | F | ◎ | 2.07 | 3.4 |
| | 7 | G | ◎ | 2.00 | 2.9 |
| | 8 | H | ◎ | 2.10 | 2.0 |
| | 9 | I | ○ | 1.96 | 1.2 |
| | 10 | J | ◎ | 2.06 | 1.4 |
| | 11 | K | ○ | 1.90 | 1.7 |
| | 12 | L | ◎ | 2.09 | 1.7 |
| Comparative Example | 1 | M | X | 1.95 | 4.4 |
| | 2 | N | X | 1.92 | 3.6 |
| | 3 | O | X | 1.93 | 3.6 |
| | 4 | P | X | 1.92 | 3.7 |
| | 5 | Q | Δ | 1.82 | 7.0 |
| | 6 | R | Δ | 1.84 | 6.7 |
| | 7 | S | Δ | 1.84 | 6.7 |

Evaluation of Sense of Surface Roughness

A sublimation thermal transfer printer (UP-DR200: product of Sony Corporation) and a genuine thermal transfer recording ribbon 2UPC-R204 (print size: 4×6) (thermal transfer sheet) were used. A chart of light gray (corresponding to a gradation level of 128 when gray and black are graded as 255 and 0, respectively) was printed on the respective thermal transfer recording sheets of Examples and Comparative Examples using these printer and thermal transfer recording ribbon. Regarding density evenness of light gray on this printed material, visual evaluation was conducted as follows.

◎: There was absolutely no sense of surface roughness, and light gray on the printed material was very even.

○: There was no sense of surface roughness.

Δ: There was a sense of surface roughness, and slight density unevenness was observed.

X: There was a strong sense of surface roughness, and severe density unevenness was observed.

Evaluation of Transfer Density

Using the sublimation thermal transfer printer and the thermal transfer recording ribbon, a solid black chart was printed on the respective thermal transfer recording sheets of Examples and Comparative Examples under a humid environment at room-temperature. The reflection density of the black solid portion was measured with Macbeth TR924. The internal temperature of the printer at the start of printing was maintained at 25° C. in order to prevent any influence of accumulated heat on the transfer density.

Evaluation of Image Light-Fastness

Using the sublimation thermal transfer printer and the thermal transfer recording ribbon, a gray patch of which the transfer density fell within a range of 1.0±0.1 was printed on the respective thermal transfer recording sheets of Examples and Comparative Examples under a humid environment at room temperature. The printed material was provided for an image light-fastness test under the following conditions. The test conditions of image light-fastness were as follows: Xenon light source; UV-cutoff filter (370 nm); 60,000 lux; chamber temperature and humidity (22° C., 55% RH); BP temperature (40° C.); and exposure (120 hours). In this test, XL75 (product of SUGA Test Instruments Ltd.) was used. A color difference before and after the exposure was measured under the following conditions: D65 light source; visual field) (2°; and ASNI A filter. In this test, Spectrolino (product of GretagMacbeth Corp.) was used.

Evaluation Result

As shown in FIG. 3, it can be understood that in the case of the receptor layer forming composition of the present invention and the thermal transfer receiving sheet having the receptor layer in which the receptor layer forming composition is coated on the base material, the surface roughness in the intermediate gradation portion is suppressed, the transfer density is high, and the image light-fastness is good. The thermal transfer printer used in this evaluation is a high-speed thermal transfer printer which can print a full-color image of a 4×6 size in approximately 8 seconds (YMC line speed of 0.7 msec). In the case of such a high-speed thermal transfer printer, since the dyes have to be transferred from the thermal transfer sheet to the receptor layer in a very short period, the image quality of the printed material is likely to be influenced by the unevenness of the base material or the receptor layer. By using the receptor layer forming composition according to the present embodiment and the thermal transfer receiving sheet having the receptor layer formed from the receptor layer forming composition, it was possible to obtain an excellent printed material with a high-speed printer.

Particularly, in Examples 1 to 3, 6 to 8, 10, and 12, the hydrophilic acrylic resin containing specific monomers, namely HMMA (hydroxymethyl methacrylate) and 2HEMA (2-hydroxyethyl methacrylate) was used. Therefore, in these examples, it was possible to obtain an excellent printed material in which the sense of surface roughness was suppressed, and the transfer density was high. Moreover, in Examples 8 to 12, the core/shell-type latex having a shell portion containing specific constituent components, namely NS2400 (1,5-penthane diol+adipic acid polyester) and T5652 (1,6-hexanediol-based polycarbonate) was used. Therefore, in these examples, the image light-fastness was further improved.

On the other hand, in Comparative Examples 1 to 4, since the hydrophilic acrylic resin according to the present invention was not included, the sense of surface roughness was strong, and the transfer density was low. In Comparative Examples 5 to 7, since (meth)acrylate components of the specific structure were not included in the core portion of the latex according to the present invention, particularly, the image light-fastness was poor, and the transfer density was low.

The present application contains subject matter related to that disclosed in Japanese Priority Patent Application JP 2009-284359 filed in the Japan Patent Office on Dec. 15, 2009, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A receptor layer forming composition of a thermal transfer receiving sheet, comprising:

a core/shell-type latex which includes a core portion made from an acrylic resin (A) and a shell portion made from a urethane resin (B); and a hydrophilic acrylic resin containing hydroxyalkyl (meth) acrylate as at least one polymerizable component, wherein the acrylic resin (A) contains substituted or unsubstituted phenoxyalkyl (meth)acrylate and/or substituted or unsubstituted phenoxy polyalkylene glycol (meth) acrylate as at least one polymerizable component thereof, and wherein the urethane resin (B) contains a carboxyl group.

2. The receptor layer forming composition according to claim 1, wherein the urethane resin includes a product of a reaction between at least one material selected from aliphatic polyester polyol and aliphatic polycarbonate diol, aliphatic polyol containing a carboxyl group, and an isocyanate compound.

3. The receptor layer forming composition according to claim 1, wherein a main polymerizable component of the hydrophilic acrylic resin includes at least one monomer selected from hydroxymethyl (meth)acrylate, 2-hydroxyethyl (meth)acrylate, 3-hydroxypropyl (meth) acrylate, and 2-hydroxypropyl (meth)acrylate.

4. A thermal transfer receiving sheet in which a receptor layer is provided on at least one surface of a base material thereof, wherein the receptor layer is formed by coating and drying a receptor layer forming composition mainly including a core/shell-type latex which includes a core portion made from an acrylic resin (A) and a shell portion made from a urethane resin (B); and a hydrophilic acrylic resin containing hydroxyalkyl (meth)acrylate as at least one polymerizable component, wherein the acrylic resin (A) contains substituted or unsubstituted phenoxyalkyl (meth)acrylate and/or substituted or unsubstituted phenoxy polyalkylene glycol (meth) acrylate as at least one polymerizable component thereof, and wherein the urethane resin (B) contains a carboxyl group.

5. The thermal transfer receiving sheet according to claim 4, wherein the urethane resin includes a product of a reaction between at least one material selected from aliphatic polyester polyol and aliphatic polycarbonate diol, aliphatic polyol containing a carboxyl group, and an isocyanate compound.

6. The thermal transfer receiving sheet according to claim 4, wherein a main polymerizable component of the hydrophilic acrylic resin includes at least one monomer selected from hydroxymethyl (meth)acrylate, 2-hydroxyethyl (meth)acrylate, 3-hydroxypropyl (meth) acrylate, and 2-hydroxypropyl (meth)aerylate.

7. The thermal transfer receiving sheet according to claim 4, wherein the base material is a polyolefin laminated paper having a void layer, the void layer containing hollow particles and provided on at least one surface of the polyolefin laminated paper sheet, and the receptor layer being provided above the void layer.

* * * * *